US006264758B1

(12) United States Patent
Perry et al.

(10) Patent No.: US 6,264,758 B1
(45) Date of Patent: Jul. 24, 2001

(54) METHOD FOR REMOVING CARBON FROM KITCHEN UTENSILS AND THE LIKE

(76) Inventors: Jonathon Perry; June Annie Lynch Perry, both of Villa 227, Philip Holzmann, Riyadh (SA)

( * ) Notice: Subject to any disclaimer, the term of this patent is extended or adjusted under 35 U.S.C. 154(b) by 0 days.

(21) Appl. No.: 09/191,839

(22) Filed: Nov. 13, 1998

(30) Foreign Application Priority Data

Nov. 14, 1997 (GB) ..... 9723970
Jul. 8, 1998 (GB) ..... 9814721

(51) Int. Cl.[7] ..... B08B 3/04; B08B 3/10

(52) U.S. Cl. ..... 134/18; 134/19; 134/25.2; 134/26; 134/39; 134/40; 134/57 D; 134/113

(58) Field of Search ..... 134/25.2, 18, 39, 134/40, 26, 19, 57 D, 113

(56) References Cited

U.S. PATENT DOCUMENTS

| | | | |
|---|---|---|---|
| 3,881,503 | 5/1975 | Fox et al. | 134/57 R |
| 4,421,131 | 12/1983 | Auvil, Jr. | 134/110 |
| 4,935,066 | 6/1990 | Wright | 134/40 |
| 5,141,009 | 8/1992 | Morantz | 134/57 R |

FOREIGN PATENT DOCUMENTS 0 282 239 A2 9/1988 (EP) .

*Primary Examiner*—Zeinab El-Arini
(74) *Attorney, Agent, or Firm*—Barnes & Thornburg

(57) ABSTRACT

A method for removing carbon from utensils includes filling a tank with a batch of carbon removing solution for removing carbon from utensils, heating the solution prior to and/or during soaking of the utensils, soaking the utensils in the tank filled with carbon removing solution for a period from 2 to 24 hours, reusing the same batch of carbon removing solution for multiple soaking treatments until the effectiveness of the solution has deteriorated, automatically emptying the batch of carbon removing solution from the tank to waste, and refilling the tank with a fresh batch of carbon removing solution.

21 Claims, 4 Drawing Sheets

METHOD FOR REMOVING CARBON FROM KITCHEN UTENSILS AND THE LIKE

The invention relates to a method for removing carbon, particularly with reference to, but not exclusively limited to, removal of carbon from cooking utensils and equipment, and an apparatus for use with the method.

In commercial kitchens, many utensils become coated with carbon after use which cannot be removed using conventional cleaning methods. It is know to remove the carbon from cooking utensils by soaking them in a tank of a solution which is effective at removing carbon. The utensils are generally soaked overnight to remove carbon and often require soaking up to 24 hours in solution to remove the carbon effectively. Using a commercially available chemical in solution, the tank will enable cleaning of utensils for approximately 1 month before fresh solution is required. Since emptying the tank is a difficult task, it must be done by trained technicians. Similar systems exist which use a cold solution in a plastic tank, again which must be emptied on a regular basis by authorized personnel.

It is an object of the present invention to provide an improved method for removal of carbon and apparatus for use therewith.

According to a first aspect of the invention there is provided a method for removing carbon from utensils comprising the steps of:

providing a tank, filling the tank with a batch of solution effective in removing carbon from utensils, soaking utensils in the tank filled with carbon removing solution for a period from 2 to 24 hours, reusing the same batch of carbon removing solution for multiple soaking treatments until the effectiveness of the solution has deteriorated, then automatically emptying the batch of solution from the tank to waste, and refilling the tank with a fresh batch of carbon removing solution.

Preferably the step of automatically emptying comprises pumping the batch of carbon removing solution to waste.

In that way the system is automated to allow untrained personnel to empty the tank.

According to a second aspect of the invention there is provided a method for removing carbon from utensils comprising the steps of providing a tank, providing a pump and a tank arranged so as to be able to pump liquid from the tank to waste, filing the tank with a batch of solution effective to remove carbon from utensils, soaking utensils in a tank for a period from 2 to 24 hours, using the same batch of solution for multiple soaking treatments until the effectiveness of the solution deteriorates, then automatically pumping the batch of solution from the tank when the effectiveness of the solution has deteriorated and refilling the tank with a fresh batch of solution.

In the present specification the terms "automatic" and "automatically" shall mean the automation of the emptying of the tank so that the tank does not need to be emptied manually. The terms shall include indicating to an operator that the tank should be emptied, the operator then effecting non-manual emptying of the tank, for example by actuating a drain valve to allow the solution to flow to waste or by activating a pump to pump the solution to waste. The terms also encompass full automation whereby solution is emptied from the tank without reference to an operator.

Preferably the step of filling the tank with solution comprises filling the tank with water and adding a chemical concentrate to dissolve in the water to form the solution.

In that way the tank can be filled from the mains water supply and the chemical can be sold as a concentrate to reduce the space that the chemical takes up in storage.

In a preferred embodiment the method includes the step of heating the solution prior to and/or during soaking of the utensils.

Preferably, the method includes the step of indicating that the solution requires replacement.

In a preferred embodiment a parameter which relates to the effectiveness of the solution is sensed. The parameter sensed is preferably the number of repetitions of the soaking step. The number of repetitions of soaking the utensils is preferably in a range of 10–100, most preferably in the range of 20–50. In that way the system is emptied before the solution loses effectiveness.

The step of emptying out the tank preferably comprises flushing the tank with fresh water while emptying the contents of the tank to waste to remove any build-up of sludge or carbon deposits in the tank.

In a preferred embodiment, the step of emptying out the tank includes spraying the side walls of the tank with clean water to wash off limescale build up on the walls.

The step of refilling the tank with solution preferably comprises circulating water in the tank to dissolve the chemical concentrate.

In another embodiment, the sensed parameter comprises the time elapsed from filling the tank. The pre-determined period of time is preferably in the range from two weeks to two months, most preferably one month.

Preferably both the number of repetitions of the soaking step and the time elapsed from filling the tank are sensed and the tank is emptied when the first preset parameter level is reached.

The method may comprise automatically sensing the parameter or parameters and automatically emptying the tank when the pre-set level of the parameter or parameters has been reached. Alternatively, when the pre-set level of the parameter or parameters has been reached there may be a further step of indicating the requirement to change the solution.

In that way, in periods of heavy usage, when the batch of solution is used frequently, the batch will be emptied more quickly and the tank refilled. However, in period so light usage, the solution will be refreshed at pre-determined intervals, most preferably one month so that the solution does not loss its effectiveness.

In a preferred embodiment the step of sensing the parameter comprises the step of sensing the pH of the carbon removing solution and emptying the tank when the pH reaches a pre-determined level.

In another embodiment the step of sensing the parameter comprises the step of sensing the proportion of grease in the solution and emptying the tank when the proportion of grease reaches a pre-determined level.

Preferably, the method includes sensing two or more of the aforementioned parameters and collating that data to determine when the batch of solution should be pumped from the tank.

In one embodiment the method includes providing a tank having two parts, a first part for spraying the utensils and the second for soaking them, the method further comprising the step of spraying soiled utensils with liquid at high pressure before soaking them. Preferably the utensils are sprayed before and after soaking.

According to a third aspect of the invention there is provided a carbon removing apparatus for use with the method of any of claims 1 to 21 in which the apparatus comprises a tank, including an inlet for carbon removing solution, an opening for utensils to be placed into the tank and a drain arranged to allow emptying of carbon removing solution in the tank from the tank to waste, the tank being arranged to allow soaking of utensils in the batch of carbon removing solution for 2 to 24 hours and to allow storage of the batch until the batch loses effectiveness.

Preferably a pump is provided for pumping carbon removing solution in the tank to waste.

According to a fourth aspect of the invention, there is provided carbon removing apparatus for use with the aforesaid method, the apparatus comprising a tank, including an inlet for carbon removing solution, an opening for utensils to be placed into the tank and a pump in fluid communication with the tank arranged to allow emptying of carbon removing solution in the tank from the tank to waste, the tank being arranged to allow soaking of utensils in a batch of carbon removing solution for 2 to 24 hours and to allow storage of the batch until the batch loses effectiveness.

Preferably, the inlet for carbon removing solution comprises a duct which is attached in use, to a mains water supply and an opening for allowing pouring of the concentrate which, when dissolved in water, forms the carbon removing solution. The concentrate may be in liquid or powder form. The inlet for the concentrate is preferably the opening for the utensils.

The opening for utensils is preferably closable by means of a lid.

A heater may be provided for heating the solution. The heater is preferably a heating element arranged within the tank.

The apparatus may further include means for supporting the utensils, clear of the floor of the tank during soaking. The support means preferably comprises a basket. The basket may include elongate upwardly extending members having handles at their upper ends whereby the basket can be loaded with utensils and lowered into the tank. The basket may be supported on protrusion which extend laterally inwardly from the walls of the tank. Alternatively, the elongate upstanding members may include a hook-like member or a loop member which engages with a loop member or hook member respectively on the wall of the tank. The basket preferably includes a mesh like filter which is arranged to catch carbon deposits removed from soaked utensils. Alternatively, the walls and floor of the basket may be mesh-like to act as a filter.

Preferably, where large utensils are to be cleaned a lifting arrangement is provided to assist in lifting the heavy utensils in and out of the tank or tank parts. The lift may comprise an electric motor which is attached to an endless belt and pulley arrangement attached to a support surface for utensils.

The apparatus may further comprise a second pump which is arranged to circulate the solution after filling of the tank. The second pump preferably circulates flush water during pumping out of the tank to aid removal of sludge and limescale.

A first timer may be provided and is preferably settable by the user to determine the soaking time for the utensils. When the first timer reaches zero, an alarm may sound. Alternatively, some other indication may be provided. For example, during soaking, a red "warning" light may be lit and at the end of the soaking a green "Ready" light may be lit.

A second timer may be provided which is arranged to determine the length of time the batch of solution has been used. Once a pre-determined period, for example one month, has expired, the second timer may activate the pump to empty the tank.

Alternatively, or in addition to the second timer, a sensor may be provided for sensing the number of soaking steps that have taken place which each batch of carbon removing solution. Once a pre-determined number of repetitions has been reached, the sensor may activate the pump to empty the tank. The sensor may be associated with the lid which closes the utensil access opening. In such a case, the sensor may simply comprise a switch which is actuated by opening and closing of the door. Alternatively, the sensor may be associated with the basket. In such a case, removal and/or replacement of the basket in the tank may actuate a switch in the tank. After a pre-determined number of switch actuations, the pump may be activated to empty the tank.

Alternatively, a calendar may be provided on the device with means to indicate the date that the solution should be disposed of In another embodiment, the aforesaid second timer is provided with an indicator, such as a light or an alarm, to indicate that disposal is required.

The pump may be activated manually to empty the tank at any time.

The tank preferably includes a level sensor to determine when the tank is empty and when the tank is full. The level sensor may comprise a floating ball/switch arrangement. Alternatively, an electrical resistance or capacitive sensor may be provided to indicate when the liquid in the tank is at the correct level.

After repeated soaking of carbon coated utensils over the extended periods required and without changing solutions for periods required and without changing solutions for periods of up to 1 to 2 months, there is often heavy limescale build up on the walls of the tank, together with thick sludge in the base of the tank. For that reason, the inlet duct for mains water preferably includes at least one spray nozzle intended to direct a spray of water against the walls of the tank when the pump is activated to empty the tank, to rinse down the walls of the tank, to wash away limescale build up. The inlet for mains water supply is preferably opened to allow water to flush the base of the tray when pumping out solution in order to remove as much carbon sludge as possible.

The tank may include an integral sludge trap at its base. The sludge trap may comprise a removable sump.

In a further embodiment the tank may include first and second parts, the first part being provided with means for directing a high pressure spray of fluid at the soiled utensils and the second part being provided for soaking the utensils.

BRIEF DESCRIPTION OF THE DRAWINGS

The carbon removal apparatus and method are now described in detail by way of example and with reference to the accompanying drawings, in which.

DETAILED DESCRIPTIONS OF ILLUSTRATIVE EMBODIMENTS

Figure 1:
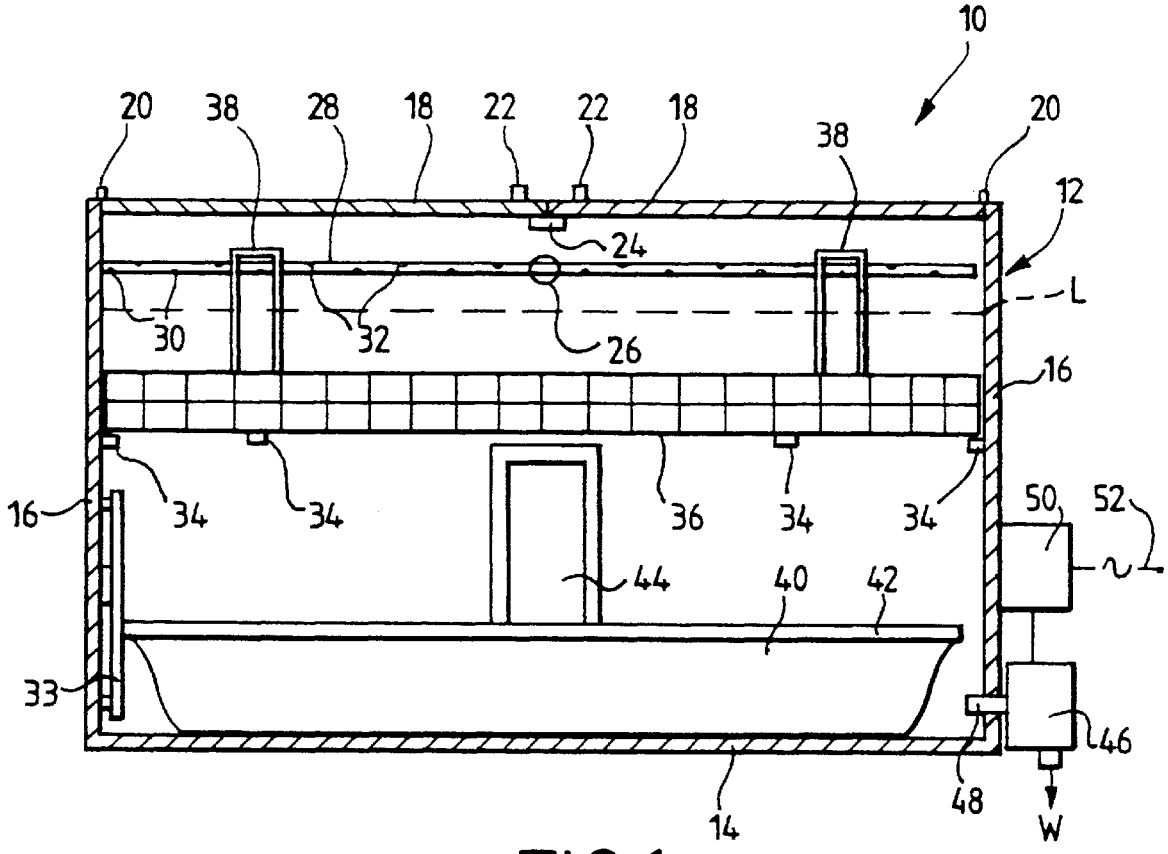
FIG. 1 is cross section through a carbon removal apparatus in accordance with the second aspect of the invention.
Figure 2:
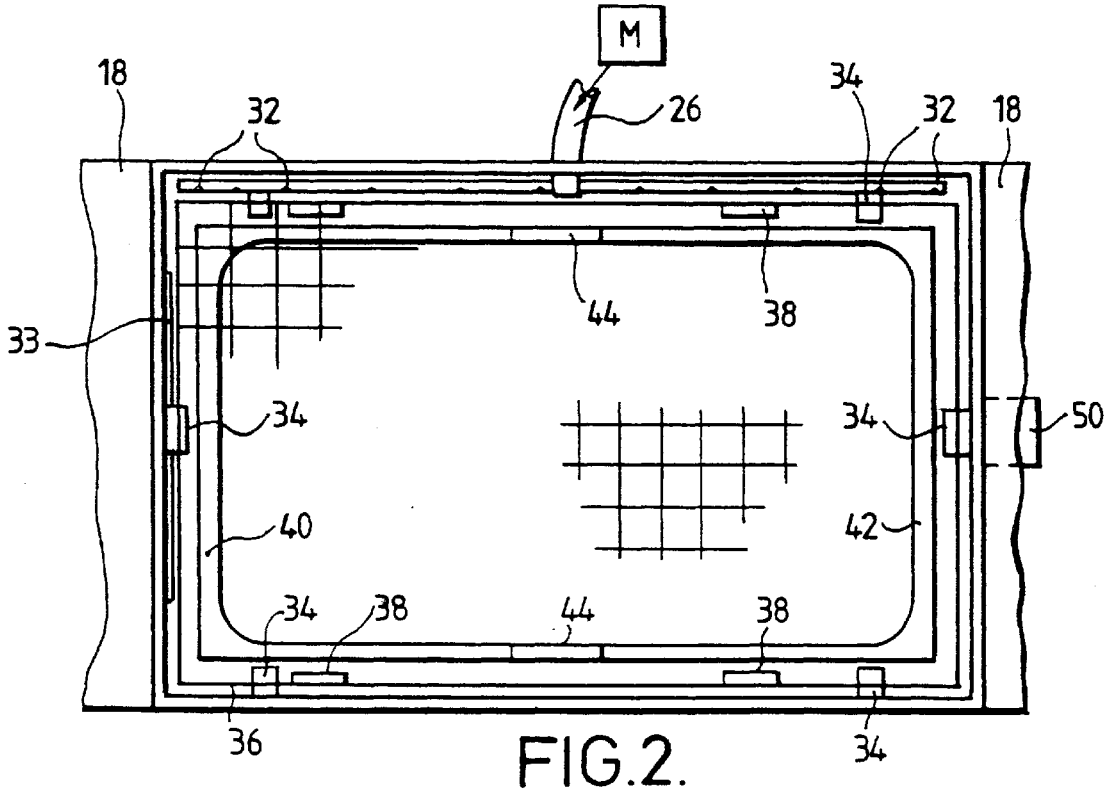
FIG. 2 is a plan view of the apparatus of FIG. 1.

In FIG. 1 an apparatus 10 for removing carbon from cooking utensils is shown. The apparatus 10 comprises a tank 12 having a rectangular base 14 with upstanding side wall 16. The top of the tank 12 is closed by two doors 18 which are hinged to the side walls 16 by means of hinges 20 along the respective edges thereof. Each door 18 has a handle 22 on the upper face thereof. The doors 18 are arranged to open upwardly and, when closed, are supported on a magnetic latch 24. The tank 12 is made from stainless steel. A duct 26 passes through one of the side walls 16 at an upper part thereof. The duct 26 is shown in more detail in FIG. 2. The duct 26 has a solenoid operated valve (not shown) therein. The duct 26 is connected to a mains water supply M (FIG. 2). Downstream of the valve, the duct 26 is connected to an elongate flow tube 28 having a plurality of spray nozzles 30, 32 spaced at regular intervals along the length thereof The nozzles 30 are arranged to spray water against the side wall through which the duct 26 extends, while the nozzles 32 are arranged to spray water against the other side walls 16.

A heating element 33 is located on an inner surface of one of the side walls 16. The heating element 33 is arranged to heat the solution after or while the tank is being filled. The side walls 16 further comprise basket support elements 34 which protrude slightly from the inner surfaces thereof In use, the basket support elements 34 support a basket 36 which carries the utensils to be cleaned. Of course, it is possible to have multiple baskets supported side by side and/or stacked one on top of the other. The basket 36 shown in FIGS. 1 and 2 has four handles 38 to aid lifting of the basket from the tank. The handles 38 are arranged to protrude above the maximum fill level of the tank indicated by a broken line at L. The basket 36 receives a filter mesh (not show) which is intended to catch carbon which has been removed from utensils to reduce the possibility of clogging of the system. A sludge trap 40 is removably located at the base 14 of the tank 12. The sludge trap 40 comprises a deep stainless steel tray 42 which is dimensioned so as to be removable from the tank 12 past the basket support elements 34, but to be large enough so that substantially all of the sludge falling from the basket 36 falls into the tray 42. The trap 40 also includes two handles 44 to facilitate removal of the trap 40 from the tank 12. A pump 46 is located at the base of the tank with an inlet tube 48 thereof extending through one of the side walls 16 at a lower part thereof The pump 46 is arranged to pump fluid from the interior of the tank 12 to waste W. A control unit 50 powers the pump 46 and also includes control circuitry for the solenoid valve in the duct 26 from the mains water supply M. The control unit 50 receives power from a mains power source 52.

The magnetic latch 24 of the doors 18 may include a micro-switch (not shown) which is connected to the control unit 50. The control unit 50 can then log each time the doors 18 are opened. Opening and closing of the doors of the tank provides an indication as to the number of repetitions of soaking of utensils that has occurred. Alternatively, or in addition to the micro-switch in the door latch 24, one or more of the baskets support elements 34 may include a micro-switch which indicates when the basket 36 has been removed and/or replaced. Again, that provides an indication as to the number of repetitions of soaking of utensils that has occurred.

The control unit 50 also includes two timers. The first timer (t1) can be set to time a period between 2 and 24 hours and to sound an alarm when the period has expired. That enables the user to set an appropriate time for soaking of utensils and the control unit 50 will sound the alarm when the preset period has expired enabling the user to remove the soaked utensils.

The second timer (t2) is arranged to time a period between 2 weeks and 2 months. Timer (t2) is reset on filling of the tank and expiry of the period set on timer (t2) indicates that the batch of solution in the tank should be pumped out.

Alternatively, means may be provided on the tank for indicating a date at which the solution should be pumped out. That could be in the form of a LCD display. Alternatively, a simple calendar display could be used. Most preferably, however, the machine will function automatically to pump out the batch of solution after, say, one month.

The micro-switches in the door latch 24 and basket support elements 34 provide an indication of the number of repetitions of soaking utensils. During heavy usage of the tank, the carbon removing solution may lose its effectiveness more quickly than the pre-determined period set on timer (t2). Accordingly, the control unit 50 can be arranged to pump out the solution after a pre-determined number of repetitions of soaking utensils.

Figure 3:
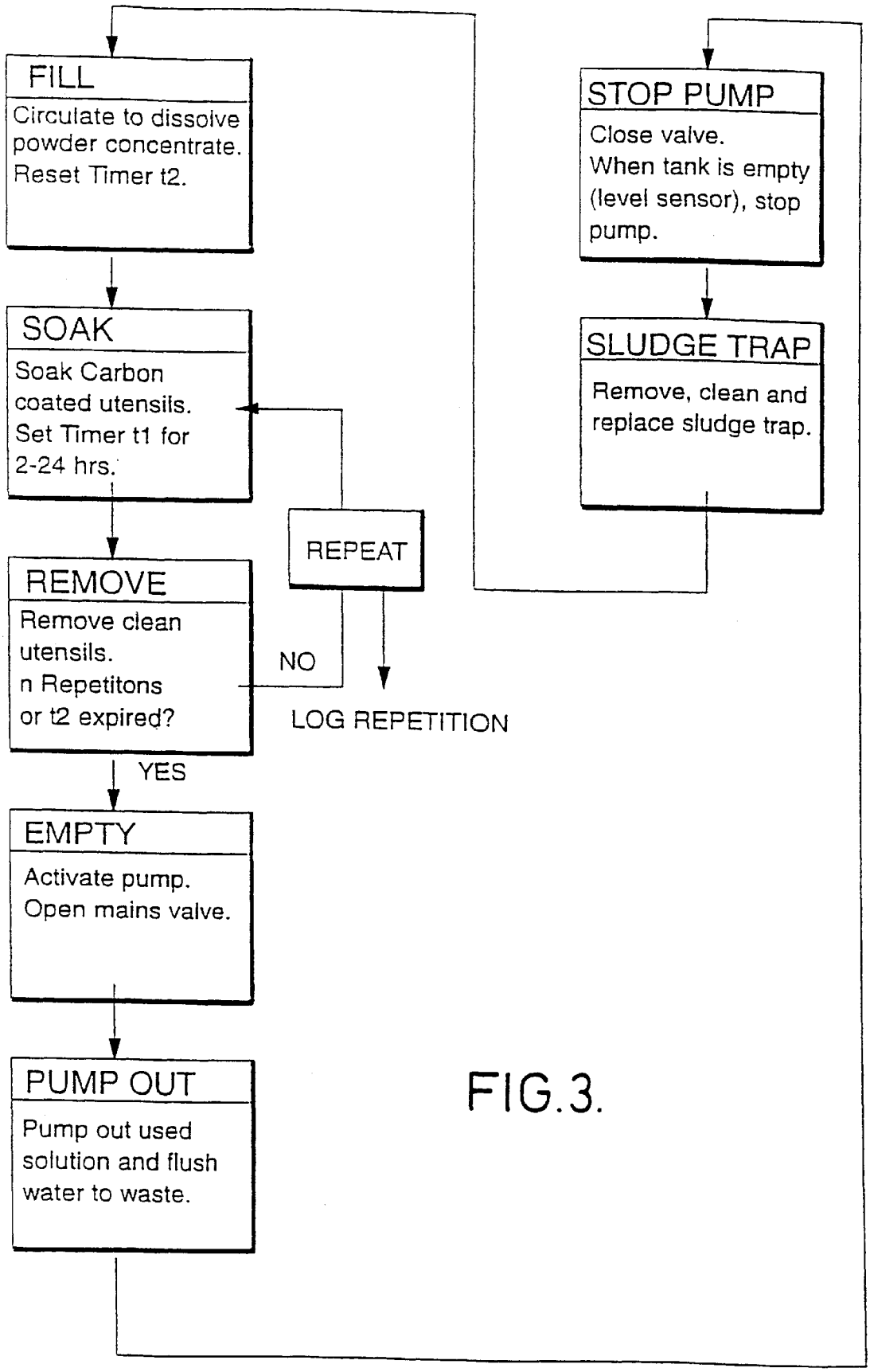
FIG. 3 is a flow chart illustrating a method in accordance with the invention.

FIG. 3 is a flow chart illustrating a preferred method in accordance with the invention.

In operation, the control unit 50 opens the solenoid valve in the ducts 26 allowing water from the mains supply M to flow into the tank 12. The pump 46 can be arranged to circulate water in the tank to aid dissolving of a powder concentrate which, when dissolved, forms a carbon removing solution. On filling the tank, the control unit 50 may automatically reset timer (t2) for a period, for example, of one month. The tank is filled to fill level L and a liquid level sensor, for example a float sensor, may be provided to indicate to the control unit 50 that the liquid has reached the desired level. The control unit 50 can then shut off the solenoid valve in duct 26 and stop the pump 46 from circulating the water.

In use, the doors 18 are opened and the basket 36 is lifted out of the tank. A fresh filter mesh (not shown) is placed in the basket and then the basket is loaded with carbon coated utensils. The basket is returned to the tank and is supported on the basket support elements 34. Placement of the basket on the basket support elements 34 activates a switch which passes a signal to the control unit 50 which logs a soaking repetition. The timer (t1) can be set by the user, according to the extent of the carbon coating on the utensils to be soaked.

After the utensils have been soaked for an appropriate period, the control unit 50 sounds an alarm and the basket 36 can be lifted from the tank to remove the utensils and the filter mesh. The basket is then reloaded with a fresh filter mesh and new carbon coated utensils and reloaded into the tank. Each time the basket is replaced in the tank a further soaking repetition is logged by the control until 50. The steps are repeated until either timer (t2) has expired or a preset number of repetitions has been reached. If either of those conditions has occurred then the control unit empties the tank 12 by activating the pump 46 to pump the solution to waste and opening the valve in the duct 26 from the mains supply M. Water from the mains supply travels along the tube 28 and sprays out of nozzles 30 and 32 to rinse the side walls 16 of the tank 12. The control unit 50 closes the valve in the duct 26 after a pre-determined rinse period and the liquid level indicator indicates to the control unit when the tank is substantially empty. The control until 50 then de-activates the pump 46. When the tank is empty the sludge trap 40 can be removed by the handles 44. The sludge trap is then cleaned and replaced in the tank 12 and the control unit is activated to return to the FILL step.

As mentioned above, in one embodiment the EMPTY, PUMP OUT and STOP PUMP stages may be initiated manually by means of pressing appropriate buttons on a control console. Alternatively, the system can be completely automatic so that there is no chance that the carbon removing solution can be used for too long.

The present invention is extremely advantageous over the prior art which required skilled technicians to empty the solution once per month. With the present invention, the solution can be pumped out of the tank at the press of a button or even automatically which removes the need for a skilled operator and that reduces the running costs of the tank, enabling the tank to be supplied to much smaller businesses than previous systems. The prior systems are also hazardous to empty and the present invention reduces the risk of emptying the system.

Figure 4:
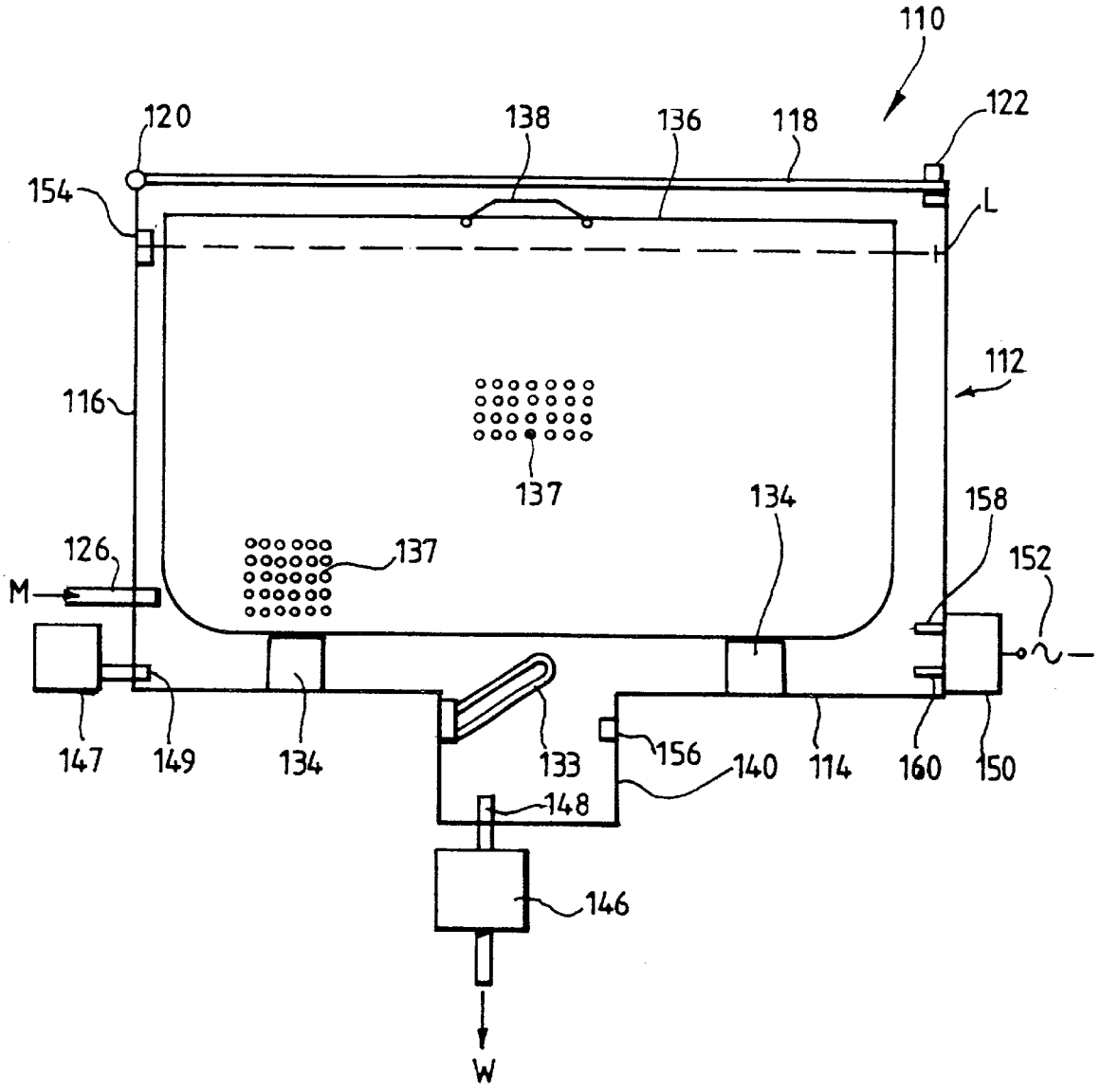
FIG. 4 is a cross section through another carbon removal apparatus in accordance with the second aspect of the invention.

In FIG. 4, another embodiment of apparatus 110 is illustrated. The apparatus 110 comprises a tank 112 having a base 114 and side walls 116.

The tank 112 has a lid 118 hinged by means of hinge 120 along one edge thereof. The lid 118 has a handle 122 at the edge opposite the hinge 120.

A duct 126 leads from a mains water supply M and extends through a side wall 116 of the tank.

A basket 136 comprising a deep steel container with perforated walls and base is support on basket supports 134. The perforations 137 in the wall are regularly spaced.

The base 114 of the tank 112 has a central recess which functions as a sludge trap 140. A heating element 133 is located on an upper part of the wall of the sludge trap 140. In that way, sludge falls to the bottom of the trap 140 without affecting the heating element 133.

A pump 146 is arranged beneath the sludge trap 140 with an inlet 148 extending into the sludge trap 140. The outlet of pump 146 is directed to waste.

A further pump 147 for circulating the solution is arranged on a side wall 116 of the tank and has an outlet 149 which extends into the tank.

A control unit 150 is located adjacent to the side wall 116 of the tank 112. The control unit is connected to several sensors with the tank and is powered from a mains supply M.

Level sensors 154, 156 are located within the tank to determine when the level of solution in the tank has reached level L, or has fallen below a minimum level. The level sensor may sense electrical resistance or capacitance.

A pH sensor 138 is located within the tank 112. A grease sensor 160 is also located within the tank 112.

Data from the pH sensor 138 and grease sensor 160 to be collated by the control unit 150 to enable automatic determination of when the tank needs to be emptied. The tank can then be emptied automatically or a visual indication or audible alarm may be given to the user to allow him to pump out the tank 112.

In use, the tank 112 is filled with water from the mains supply M via duct 126. The heating element 155 is activated to heat the water. The temperature of the water may be monitored, preferably by the control unit 150 and an indication that the temperature is right for addition of powder concentrate may be given. Level sensor 154 indicates when the tank is full and the control unit prevents more water entering the tank.

When the powder is added the user can accelerate solution of the powder by activating manually circulating pump 147 to stir the water in the tank 112.

The basket 136 is loaded with carbon coated utensils and left to soak. As with the apparatus of FIGS. 1 and 2 a timer may be provided to time the soaking step.

The soaking step may be enhanced by the user manually activating the pump 147 to stir the solution.

The pH and grease sensors 138 and 160 respectively pass sensed data to the control unit 150. If the pH and/or grease level reaches a preset level then the control unit 150 will either provide an indication that the tank should be emptied or it may initiate pumps 146, 147 and mains supply M. In that way, the pump 146 empties the tank and pump 147 stirs the solution to ensure solid deposits are not left in the tank.

Figure 5:
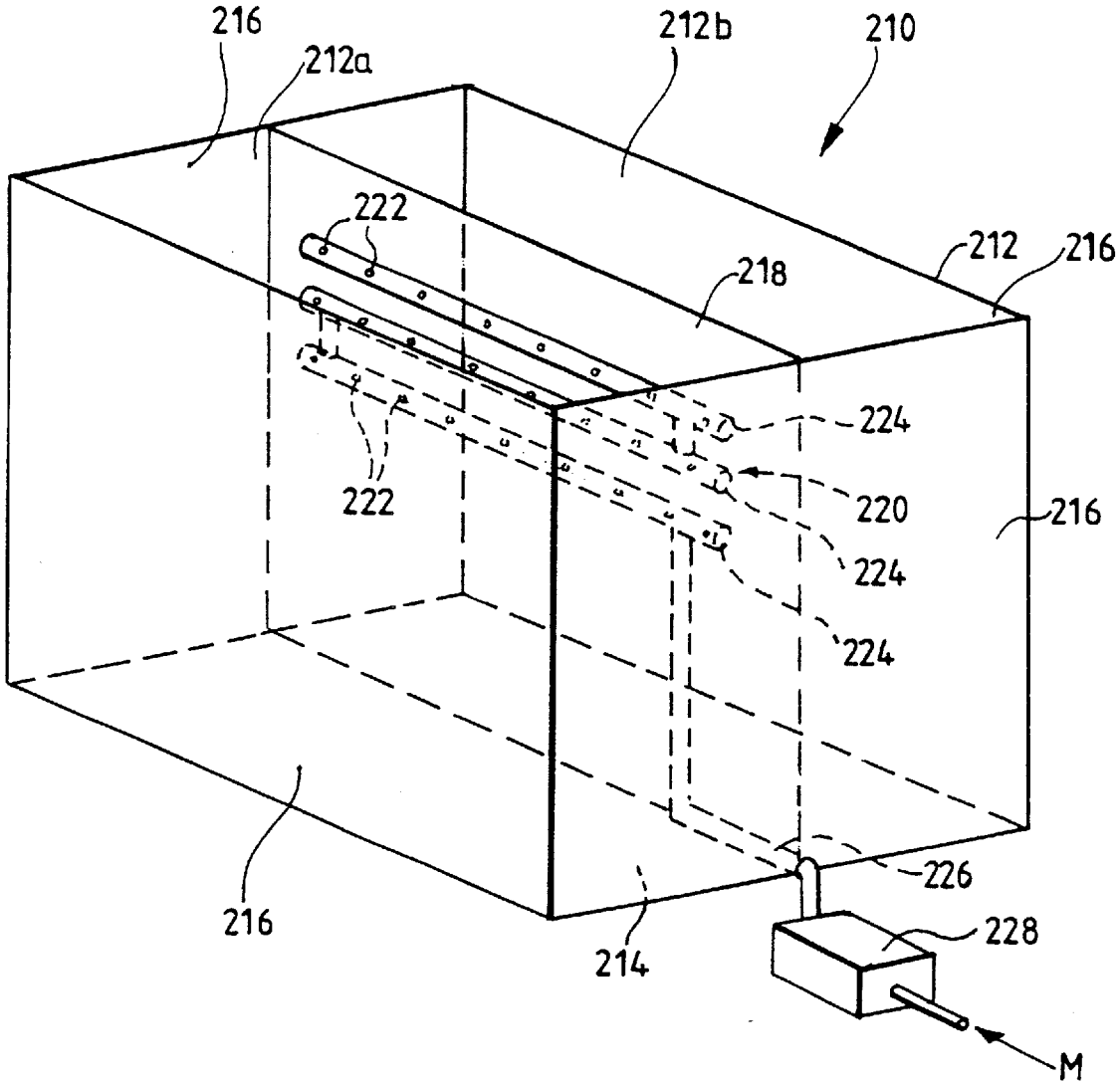
FIG. 5 is a perspective view of a further carbon removal apparatus in accordance with the invention.

In FIG. 5 an apparatus 210 for removing carbon from cooking utensils is shown. The apparatus 210 comprises a tank 212 comprising a rectangular base 214 and upstanding side walls 216. The top of the tank 212 is closed by two doors (not shown) in a similar manner to that shown in FIG. 1. The tank 212 is divided into two parts 212*a* and 212*b* by a partition walls 218. The first part 212*a* is for spraying cooking utensils prior to soaking in the carbon removing solution and the second part 212*b* is for soaking utensils. The part 212*b* is substantially similar to the tanks described in FIGS. 1 and 4 and thus that part will not be described in detail.

The part 212*a* for spraying the utensils comprises a spray manifold 228 on the partition wall 218 and a second spray manifold 220 arranged on the wall 215 opposite the partition wall 218. That spray manifold is not shown in order to improve the clarity of FIG. 5. The manifold 220 comprises a plurality (three shown) of rows of spray nozzles 222 in fluid communication with each other. In the embodiment shown, the manifold comprises three pipes 224 when are interconnected in fluid communication. On each of the pipes, facing inwardly of the tank part 212*a*, there are formed spray nozzles 222. The bottom pipe of the three pipes 224 is connected to a supply pipe 226 from a pump 228. The pump 228 receives water from a mains supply M and pumps the water under high pressure to the manifold pipes 224. Water escapes under high pressure via the spray nozzles 222 which are arranged so that they direct the resultant spray towards the middle of the tank part 212*a*. In use, a basket of utensils is loaded into the tank part 212*a* in a similar manner to that described previously. The pump 228 is activated resulting in high pressure sprays being directed towards the contents of the basket (not shown). That step is intended to dislodge any stubborn or large carbon buildups. The pump 228 is connected to the other water manifold 220 (not shown) so that the utensils are sprayed under high pressure from both sides.

Once the spraying step has been completed, the utensils are removed from tank part 212*a* and placed in tank part 212*b* where they can soak in the carbon removing solution for 2 to 24 hours depending upon the period set by the user. Preferably, once the pre-determined soaking period has expired, the utensils can be removed from the part 212*b* of the tank and placed again in the part 212*a* whereupon the pump 228 is activated to cause the utensils to be sprayed again under high pressure. Any residual carbon remaining on the utensils after the soaking step is thus removed by the high pressure sprays. The pump 228 could be independent of the pump 46 used to fill and flush the tank or, in another embodiment, the pump 228 acts both to provide spray water to the spray nozzles 222 of the manifold 220 in the spray section 12*a* of the tank and to pump out and pump in fluid into the soaking section of the tank 212*a*. It will appreciated that features shown in relation to the tanks in FIGS. 1 and 4 can be incorporated into the tank of FIG. 5.

What is claimed is:

1. A method for removing carbon from utensils comprising providing a tank, filling the tank with a batch of carbon removing solution for removing carbon from utensils, heating the carbon removing solution at at least one of the following times: (1) prior to soaking of the utensils, and (2) during soaking of the utensils, soaking utensils in the tank filled with carbon removing solution for a period from 2 to 24 hours, reusing the carbon removing solution for treatment, sensing at least one parameter of the carbon removing solution, then automatically emptying the carbon removing solution from the tank to waste, and refilling the tank with a fresh batch of carbon removing solution.

2. The method according to claim 1 in which automatically emptying the batch of carbon removing solution comprises pumping the batch of carbon removing solution to waste.

3. The method according to claim 1, wherein filling the tank with carbon removing solution comprises filling the tank with water and adding a chemical concentrate to dissolve in the water to form the carbon removing solution.

4. The method according to claim 3 in which refilling the tank with carbon removing solution comprises circulating water in the tank to dissolve chemical concentrate.

5. The method according to claim 1 further including indicating to an operator that the carbon removing solution requires replacement.

6. The method according to claim 1 including automatically sensing the at least one parameter and automatically emptying the tank when a pre-set level of the at least one parameter has been reached.

7. The method according to claim 1, further including indicating a requirement to change the carbon removing solution.

8. The method according to claim 1 in which the sensed parameter is the number of times soaking has been conducted.

9. The method according to claim 8 wherein the number of soakings is between 10 and 100.

10. The method according to claim 8 wherein the number of soakings is in the range of 20 to 50.

11. The method according to claim 1 in which the sensed parameter comprises elapsed time since last refilling the tank.

12. The method according to claim 11 in which the time elapsed since the last refilling of the tank is in the range from two weeks to two months.

13. The method according to claim 11 in which the time elapsed since the last refilling of the tank is about one month.

14. The method according to claim 1 in which both number of repetitions of the soaking and elapsed time since last refilling the tank are sensed and the tank is emptied when a pre-set level of one of the number of repetitions and elapsed time reaches its pre-set level is reached.

15. The method according to claim 1 in which sensing the parameter comprises sensing a pH value of the carbon removing solution, the method further including emptying the tank when the pH reaches a pre-determined level.

16. The method according to claim 1 in which sensing the parameter comprises sensing a proportion of grease in the solution, the method further including emptying the tank when the proportion of grease reaches a pre-determined level.

17. The method according to claim 1 further including sensing information, including: an occurrence of at least two repetitions of soaking, time elapsed since a preceding application of fresh solution, a pH of the solution and a proportion of grease in the solution, and collating the sensed information to determine when the batch of solution should be emptied from the tank.

18. The method according to claim 1 in which emptying the tank comprises flushing the tank with fresh water while emptying the tank to waste in order to reduce build up of deposits in the tank.

19. The method according to claim 1 in which emptying the tank includes spraying side walls of the tank with clean water to reduce build up on the walls.

20. The method according to claim 1 including providing a tank having a first part for spraying the utensils and a second part for soaking them, and spraying soiled utensils at high pressure before soaking them.

21. The method according to claim 20 including spraying the utensils before and after soaking the utensils.

* * * * *